United States Patent [19]

Wood

[11] Patent Number: 4,921,291

[45] Date of Patent: May 1, 1990

[54] LOAD LIFTING APPARATUS

[75] Inventor: Anthony M. Wood, Sheffield, England

[73] Assignee: River Don Castings Limited, Sheffield, United Kingdom

[21] Appl. No.: 222,072

[22] Filed: Jul. 20, 1988

[30] Foreign Application Priority Data

Jul. 22, 1987 [GB] United Kingdom ..... 8717355

[51] Int. Cl.[5] ..... B66C 1/62

[52] U.S. Cl. ..... 294/90; 294/119.2

[58] Field of Search ..... 294/1.1, 31.2, 67.1, 294/67.3, 68.1, 68.26, 68.27, 68.3, 74, 86.4, 90, 91, 119.2

[56] References Cited

U.S. PATENT DOCUMENTS

| | | | |
|---|---|---|---|
| 986,388 | 3/1911 | Heggem | 294/90 |
| 1,543,966 | 6/1925 | Williams | 294/90 |
| 2,296,182 | 9/1942 | Ratigan | 294/86.4 X |
| 2,875,982 | 3/1959 | Unglesby | 294/90 X |

FOREIGN PATENT DOCUMENTS

| | | | |
|---|---|---|---|
| 956411 | 9/1982 | U.S.S.R. | 294/119.2 |
| 1515946 | 6/1978 | United Kingdom . | |
| 2158805 | 11/1985 | United Kingdom . | |
| 2171389 | 8/1986 | United Kingdom . | |

*Primary Examiner*—Johnny D. Cherry

*Attorney, Agent, or Firm*—Kinney & Lange

[57] ABSTRACT

A padear for lifting heavy structures, includes at least two separable sections which, on assembly, embrace a component of the structure to be lifted. At least one bollard protrudes outwardly from the external circumference of the padear to receive a lifting cable. The padear is preferably separable along at least one substantially radial plane which passes through the or each bollard to divide the same into two sections.

8 Claims, 1 Drawing Sheet

LOAD LIFTING APPARATUS

FIELD OF THE INVENTION

This invention relates to suspension fittings for use in the lifting and maneuvering of heavy structures.

In the civil engineering business, it is often necessary to lift and maneuver heavy steel frameworks or structures by means of cranes or the like. Conventionally, bollard containing members to which lifting cables can be secured are welded to or formed integrally with the frameworks to be lifted; these members must, naturally, be very strong and provide geometrical cable support and guidance without causing cable distortions.

One example of an operation where heavy steel structures need to be lifted and/or maneuvered into place is the off-shore engineering business where structures such as modules, deck frames and platform substructures need to be lifted by means of floating cranes.

DESCRIPTION OF THE PRIOR ART

As mentioned previously, structural members to which the lifting cables are to be secured have hitherto either been welded to the structure to be lifted or have been formed as an integral part thereof. Because of the general increase in the weights of such structures, welding of padears and other bollards including lifting members to the structures has become increasingly complicated and expensive. Where a lifting member forms an integral part of a structure to be lifted, it must, of necessity, be so located and designed that its presence does not prove to be an encumbrance in the future.

Traditionally, lifting members have generally only been used on one occasion thereby leading to high costs.

Examples of known padears can be seen from British Patent 2158805 and Application 2171389A. Both of the padears disclosed are of integral construction and, accordingly, suffer from the disadvantages discussed above. A lifting cradle which comprises two parts bolted together is disclosed in British Patent 1515946. However, the cradle disclosed does not include any equivalent to an outwardly protruding bollard as required for padear operation.

SUMMARY OF THE INVENTION

The present invention setsout to provide a lifting member which does not suffer from the disadvantages referred to above.

According to the present invention in one aspect, there is provided a padear for lifting heavy structures, the padear including at least two separable sections which, on assembly, embrace a component of the structure to be lifted and at least one bollard protruding outwardly from its external circumference. The padear is preferably separable along at least one substantially radial plane which passes through a bollard to divide the sameinto two sections; where the padear includes two bollards the sections are preferably separable along substantially radial planes which pass through the two bollards.

BRIEF DESCRIPTION OF THE DRAWINGS

The invention will now be described by way of example only with reference to the accompanying diagrammatic drawings in which.

DESCRIPTION OF THE PREFERRED EMBODIMENTS OF THE INVENTION

Figure 1:
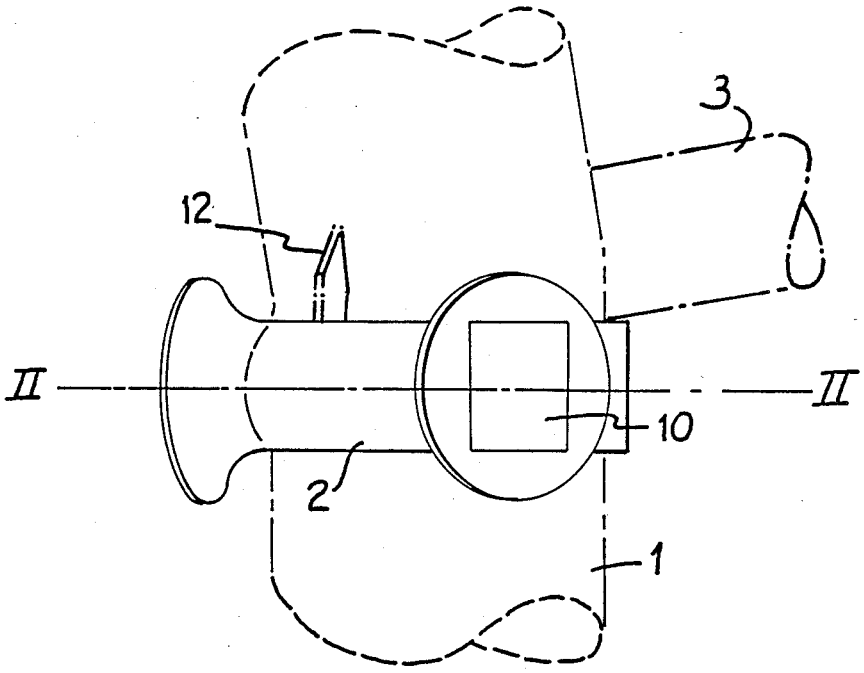
FIG. 1 is a side view of a padear in accordance with the invention located about the circumference of an off-shore jacket to be lifted.

In the drawings, the off-shore structure to be lifted is indicated by reference numeral 1 and the padear by reference numeral 2. The padear may be conveniently cast from steel or fabricated by other means. As will be seen from the drawings, the padear 2 is located about one column of the structure 1 firmly to grip the same and below one structural arm 3. Thus, the internal diameter of the padear 2 is substantially the same as the external diameter of the structure 1. The device may either grip the member by interference or, alternatively, may be a loose fit and may contact shear plates 12 welded to the member.

The padear includes two bollards 4 which protrude radially outwardly from its external circumference. Each bollard is formed with a generally convex external surface to receive a sling or lifting rope 6 of a crane.

Figure 2:
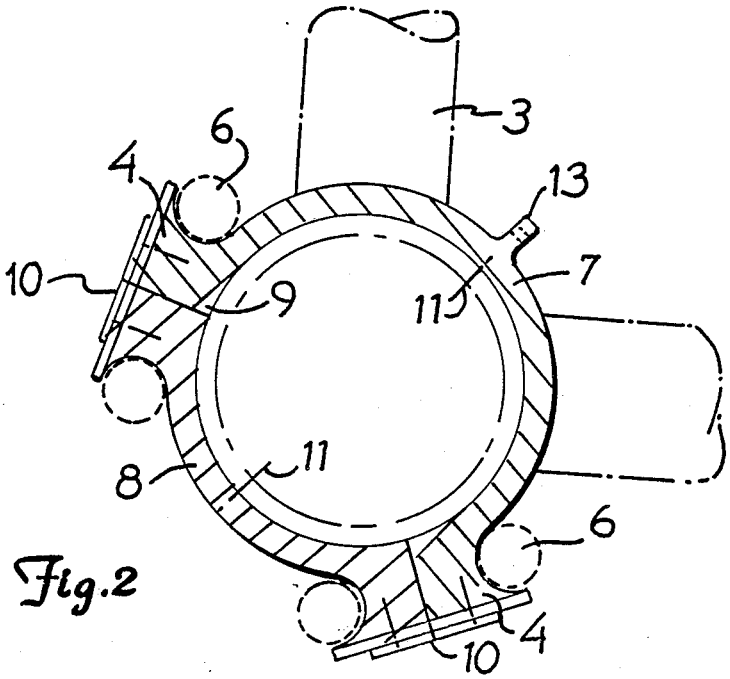
FIG. 2 is a section taken through line II—II of FIG. 1.

As will be seen from FIG. 2, the padear is split into two separable segments 7, 8 along planes which extend radially and centrally through each bollard. The internal edge faces of one segment 7 are cut away as indicated by reference numeral 9 to facilitate fitting and removal.

In use, the two padear segments are located about the structure to be lifted and may be retained initially together and in place by means of, for example, plate 10 and/or pin 11 fixings passing through the padear and into the off-shore structure or, indeed, by other methods. As seen in FIG. 2, in a preferred embodiment the padear segments 7 and 8 and held in place by pins 11 which pass through the padear segments 7 and 8 and into the off-shore structure 1. These plate and pin fixings are provided, merely, to hold the padear in position prior to the crane cables being positioned about the bollards in the manner shown in FIG. 2 whereupon the presence of the slings on the bollards becomes the primary clamping method. Once the cables are in position and the lifting procedure initiated, the abutting faces of the padear segments are forced together by the applied lifting weight effectively to define an annular lifting member. When the lifting procedure has been completed, the cables are removed from the bollards and the plates and pins removed, thereby enabling the padear segments to be removed from the structure for use at a later date.

It is to be understood that the foregoing is merely exemplary of one embodiment of a lifting member in accordance with the invention and that modifications can be made thereto without departing from the true scope of the invention. Thus, the padear could include more than two segments and only one or more than two bollards, the bollards extending radially to the central axis of the padear, or inclined thereto. While cylindrical sections are shown here for lifting, a similar device could be used for rectangular or I section members.

Padeyes 13 and the like may also be provided to facilitate handling.

I claim:

1. A padear for lifting heavy structures, the padear comprising:

two separable padear sections which on assembly define an internal face to embrace a component of the structure to be lifted and an external circumference, and which are separable along two separate, non-coplanar radially extending planes that intersect along a longitudinal centerline of the component of the structure to be lifted; and two bollards which project outwardly from the external circumference of the padear, with each bollard having one of the separate planes passing centrally therethrough and with the padear sections being retained in abutting contact by lifting forces applied through the bollards.

2. A padear as claimed in claim 1 wherein means are provided for initially retaining the sections together.

3. A padear as claimed in claim 1 wherein the internal face of at least one padear section is cut away to facilitate fitting and removal of the sections.

4. A padear for lifting heavy structures, the padear comprising:

two separable sections which on assembly define a padear assembly to embrace a component of the structure to be lifted, with the sections being separable along two separate planes that extend radially outwardly from the padear assembly and that intersect along a longitudinal centerline of the component of the structure to be lifted at an obtuse angle ; and tow bollards which project radially outwardly from the padear assembly, with each bollard being longitudinally bisected by one of the separate planes.

5. A padear as claimed in claim 4 wherein the sections of the padear assembly are retained in abutting contact by an external lifting force applied to the bollards.

6. A padear as claimed in claim 4 wherein means are provided for initially retaining the sections together.

7. A padear as claimed in claim 6 wherein the retaining means comprises at least one pin passing through each padear section and into the structure to be lifted.

8. A padear as claimed in claim 4 wherein an internal face of at least one padear section is cut away to facilitate fitting and removal of the padear assembly about the component of the structure to be lifted.

* * * * *

UNITED STATES PATENT AND TRADEMARK OFFICE

CERTIFICATE OF CORRECTION

PATENT NO. : 4,921,291

DATED : May 1, 1990

INVENTOR(S) : Anthony M. Wood

It is certified that error appears in the above-identified patent and that said Letters Patent is hereby corrected as shown below:

Col. 4, line 7, delet "tow", insert --two--.

Signed and Sealed this

Twentieth Day of August, 1991

*Attest:*

HARRY F. MANBECK, JR.

*Attesting Officer*

*Commissioner of Patents and Trademarks*